US005404071A

United States Patent [19]

Son

[11] Patent Number: 5,404,071

[45] Date of Patent: Apr. 4, 1995

[54] DYNAMIC FOCUSING ELECTRON GUN

[75] Inventor: Wan-jae Son, Suwon, Rep. of Korea

[73] Assignee: Samsung Electron Devices Co., Ltd., Kyungki-do, Rep. of Korea

[21] Appl. No.: 29,483

[22] Filed: Mar. 11, 1993

[30] Foreign Application Priority Data

Aug. 12, 1992 [KR] Rep. of Korea ..... 92-14454

[51] Int. Cl.[6] ..... H01J 29/56

[52] U.S. Cl. ..... 313/414; 313/449; 315/15; 315/382

[58] Field of Search ..... 313/449, 414, 453, 412, 313/413; 315/14, 15, 382

[56] References Cited

U.S. PATENT DOCUMENTS 5,023,508 6/1991 Park ..... 313/414

5,025,189 6/1991 Son ..... 313/414

5,281,896 1/1994 Bae et al. ..... 313/414 X

*Primary Examiner*—Donald J. Yusko

*Assistant Examiner*—N. D. Patel

*Attorney, Agent, or Firm*—Lowe, Price, LeBlanc & Becker

[57] ABSTRACT

A dynamic focusing electron gun is provided which includes a cathode and first and second grids which collectively form a triode, a plurality of electrodes for forming an auxiliary lens, and an anode installed adjacent to the final electrode of the auxiliary lens for forming a main lens. Electron beam passing holes are formed in the electrodes of the auxiliary lens so that an electron beam is repeatedly and alternately deformed in the sequence of the vertically-elongated and then horizontally-elongated (or horizontally-elongated and then vertically-elongated) shapes, constituting more than two quadrupole lenses of opposing polarities.

18 Claims, 4 Drawing Sheets

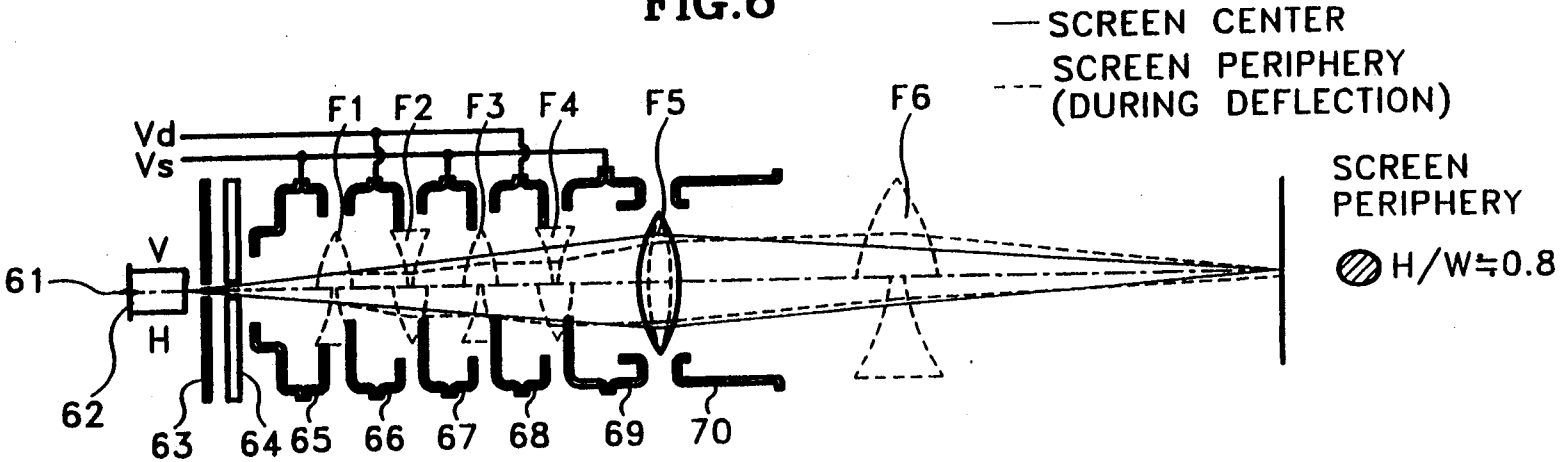
FIG. 6
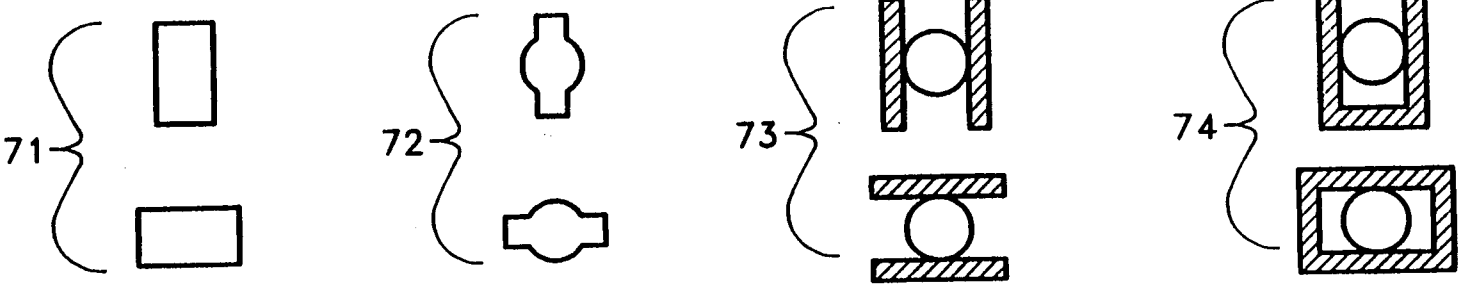
FIG. 7(a)
FIG. 7(b)
FIG. 7(c)
FIG. 7(d)

DYNAMIC FOCUSING ELECTRON GUN

BACKGROUND OF THE INVENTION

The present invention relates to an in-line electron gun for a cathode ray tube (CRT), and more particularly to a dynamic focusing electron gun for forming circular beam spots throughout a large, flat screen for a color CRT having a wide deflection angle.

Generally, an in-line electron gun for a color CRT is composed of a heater, a cathode and first through fourth grids. A picture is produced by the following sequence in the color cathode ray tube: (1) thermions (hereinafter termed electrons) are emitted; (2) the amount of emitted electrons is controlled by an external signal; (3) the electron beam is focused; and (4) the emitted electrons are accelerated to strike a phosphor screen.

In the above sequence, the first and second steps are performed by the cathode and the first and second grids (called a triode). When the cathode is heated by the heater, the electrons are emitted from the surface of the cathode. The emitted electrons pass through the passing holes of the first and second grids.

The third step is primarily performed by a main lens formed between the first and second focusing electrodes. The electrons having passed through the holes of the first and second grids are prefocused by a prefocusing lens formed by the second grid and first focusing electrode and are accelerated and focused by the main lens. Here, if the voltage applied to the first focusing electrode (focusing voltage) is controlled, the focusing state can be controlled so that a picture of the intended quality is realized on the screen.

The fourth step is carried out by a shadow mask and the second focusing electrode, that is, an anode, and graphite internally coated on the inner surface of the color CRT. Here, with the electrons being negative charges, a high positive voltage is applied to the anode so as to attract the electrons and cause them to strike a phosphor screen.

A conventional in-line electron gun for color CRT will be described with reference to FIGS. 1 and 2. In each of the attached drawings, the portion above the central dot-and-dash line shows the vertical half section of the electron gun, while the portion below the horizontal half section. The solid line indicates the path of the electron beam when directed at the screen center, and the dotted line indicates the deflection path of the electron beam around the periphery of the screen.

In FIG. 1, a conventional static focusing electron gun does not compensate for the over-focus in the vertical direction nor under-focus in the horizontal direction which are caused by a deflection yoke lens A2 and produced when the electron beam emitted from a cathode 2 is deflected toward the screen periphery by the deflection yoke. Hence, an electron beam spot formed around the screen periphery has a halo vertically and a thin laterally-elongated core horizontally. These deteriorate picture quality.

In order to improve the vertical halo around the screen periphery of the static focusing electron gun, a dynamic focusing electron gun with a quadrupole lens which is an auxiliary lens has been proposed. In the quadrupole lens, when the electron beam is emitted from the cathode 2 and is deflected toward the screen periphery, a dynamic focus voltage modulated by being synchronized with a deflection signal of the deflection yoke is applied so as to compensate for the oblique astigmatism and focal length of the deflected electron beam.

In FIG. 2 illustrating the conventional dynamic focusing electron gun, when the electron beach emitted from cathode 22 is deflected toward the screen periphery, the electron beam diverges vertically by a quadrupole lens B1 formed by second focusing electrode 26 and first and third focusing electrodes 25 and 27 to which a dynamic focus voltage Vd modulated by being synchronized with the deflection signal of the deflection yoke is applied. Then, after passing the periphery of a main lens B2, the electron beam proceeds in parallel. Passing the periphery of a deflection yoke convergent lens B3, the electron beam is under an intense convergent action, resulting in excessively and vertically converged electron beam spot. Meanwhile, since the electron beam is collimated by quadrupole lens B1, passes the central portion of main lens B2, is incident on deflection yoke divergent lens B3 at a small convergent angle and diverges by deflection yoke divergent lens B3, the electron beam spot becomes horizontally elongated, compared with the vertical beam spot.

Accordingly, in the conventional dynamic focusing electron gun, even though the vertical halo is not created, a moiré phenomenon is evident on the screen, since the height of the electron beam spot is much smaller than that of the electron beam passing hole in the shadow mask. Moreover, the size of the horizontally-elongated core is nearly the same as that of the static focusing electron gun. As a result, the conventional dynamic focusing electron gun offers no real improvement.

SUMMARY OF THE INVENTION

Therefore, it is an object of the present invention to provide a dynamic focusing electron gun which improves the vertical moiré phenomenon and horizontal elongation of the electron beam spot so as to form nearly-circular electron beam spots throughout the screen and acquire a good quality picture, even when an electron beam is deflected toward the periphery of the screen.

To accomplish The object, there is provided a dynamic focusing electron gun comprising a cathode and first and second grids which collectively form a triode, a plurality of electrodes for forming an auxiliary lens, and an anode installed adjacent to the final electrode of the auxiliary lens to form a main lens, wherein electron beam passing holes are formed in each of the plurality of electrodes for forming the auxiliary lens so that an electron beam is repeatedly and alternately deformed in the sequence of the vertically-elongated and then horizontally-elongated (or horizontally-elongated and then vertically-elongated) shapes, so as to form more than two quadrupole lenses of opposing polarities.

In one embodiment, the auxiliary lens has three electrodes, three vertically-elongated electron beam passing holes are provided on the electron beam outgoing plane of a first focusing electrode of the auxiliary lens, three horizontally-elongated electron beam passing holes and three vertically-elongated electron beam passing holes are formed on the electron beam incoming and outgoing planes of a second focusing electrode which is the second electrode of the auxiliary lens, respectively, three horizontally-elongated electron beam passing holes are formed on the electron beam incoming plane of a third focusing electrode of the auxiliary lens, a dynamic focus voltage modulated by being synchronized with a deflection signal of a deflection yoke is applied to the first and third focusing electrodes, and a static focus voltage is applied to the second focusing electrode to form two quadrupole lenses of opposing polarities.

BRIEF DESCRIPTION OF THE DRAWINGS

The above object and other advantages of the present invention will become more apparent by describing in detail a preferred embodiment thereof with reference to the attached drawings in which:

FIG. 6 is a schematic cross-sectional view of a fourth embodiment of the present invention; and FIG. 7 illustrates various shapes of an electron beam passing hole of a quadrupole lens.

DETAILED DESCRIPTION OF THE INVENTION

Embodiment 1

Figure 1:
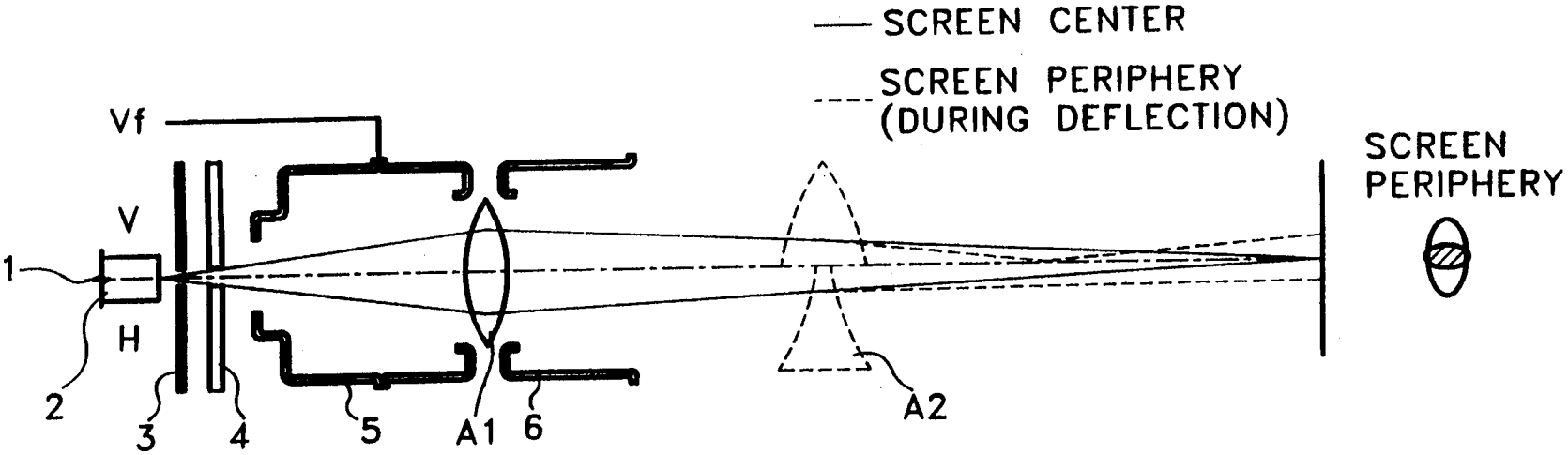
FIG. 1 (PRIOR ART)
FIG. 1 is a schematic cross-sectional view of a conventional static focusing electron gun.
Figure 2:
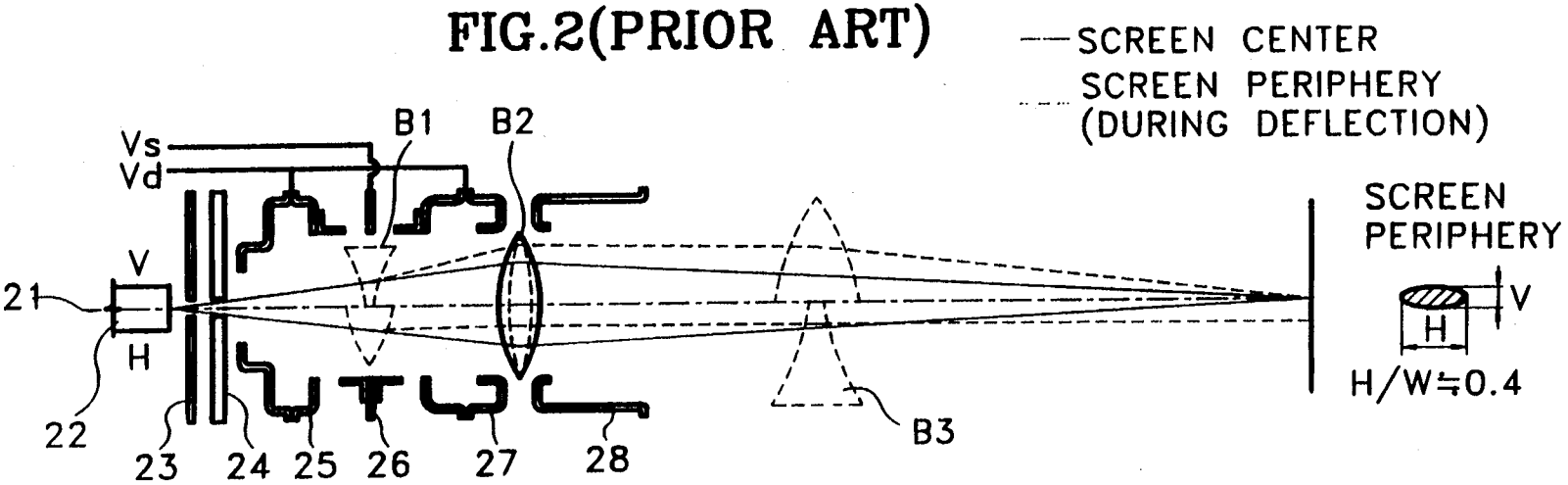
FIG.2(PRIOR ART)
FIG. 2 is a schematic cross-sectional view of a conventional dynamic focusing electron gun.
Figure 3:
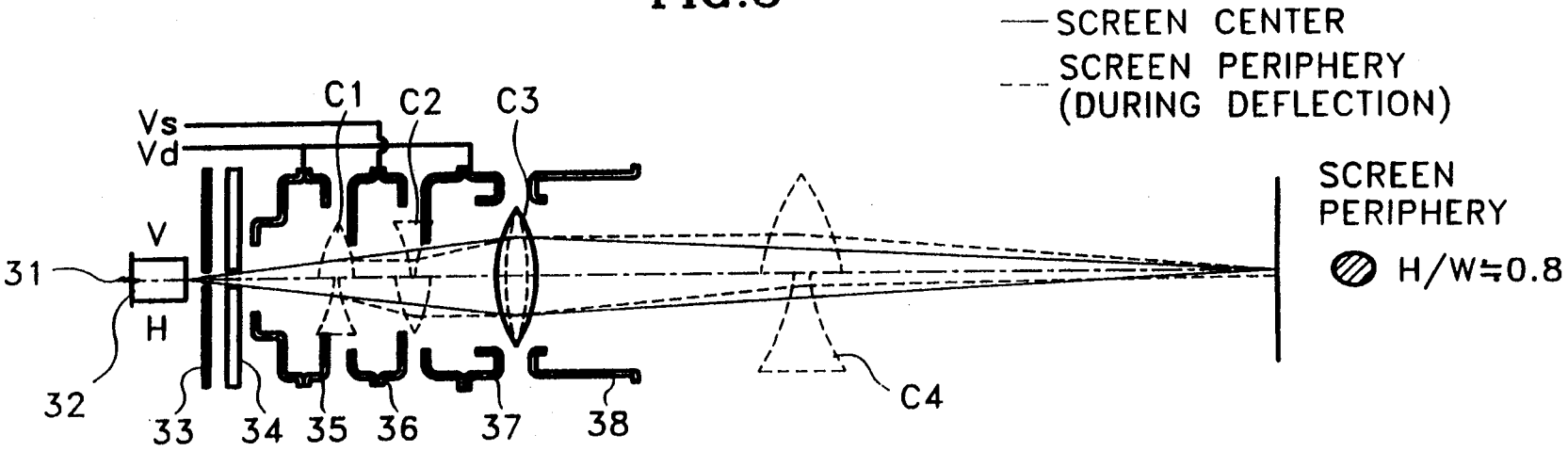
FIG. 3 is a schematic cross-sectional view of a dynamic focusing electron gun of the present invention.

Referring to FIG. 3, the dynamic focusing electron gun comprises cathode 32, first grid 33 and second grid 34 which constitute a triode, first quadrupole lens C1 and secondary quadrupole lens C2 which are two quadrupole lenses having opposing polarities, first, second and third focusing electrodes 35, 36 and 37 which form first and secondary quadrupole lenses C1 and C2, and accelerating electrode 38 installed adjacent to third focusing electrode 37 to form main lens C3.

Here, three vertically-elongated electron beam passing holes are provided on the electron beam outgoing plane of first focusing electrode 35. Three horizontally-elongated electron beam passing holes and three vertically-elongated electron beam passing holes are formed on the electron beam incoming and outgoing planes of second focusing electrode 36, respectively. Three horizontally-elongated electron beam passing holes are formed on the electron beam incoming plane of third focusing electrode 37. A dynamic focus voltage Vd modulated by being synchronized with the deflection signal of the deflection yoke is applied to first and third focusing electrodes 35 and 37. A static focus voltage Vs is applied to second focusing electrode 36.

The operation of the dynamic focusing electron gun according to the present invention will be described below.

Referring to FIG. 3, as a voltage is applied to each of the electrodes of the dynamic focusing electron gun, an electron beam emitted from cathode 32 is projected onto the phosphor screen to form a pixel, a group of which makes up a picture. The projection states of the electron beam is described below, being divided into the center and periphery of the screen.

First, since the electron beam is not deflected by the deflection yoke, an equipotential static focus voltage Vs is applied to each of first, second and third focusing electrodes 35, 36 and 37, so that it is projected toward the screen's center. When this happens, the electron beam is pre-focused as it passes through the pre-focus lens formed by second grid 34 and first focusing electrode 35. Passing through main lens C3 formed by third focusing electrode 37 and accelerating electrode 38, the electron beam is finally focused and accelerated to form a circular beam spot on the center of the screen to result in optimum landing.

On the other hand, when the electron beam is projected toward the screen's periphery, since dynamic focus voltage Vd modulated by being synchronized with the deflection signal of the deflection yoke is applied to first and third focusing electrodes 35 and 37, two electrostatic quadrupole lenses having opposing polarities, that is, first quadrupole lens C1 and secondary quadrupole lens C2 are formed between first, second and third focusing electrodes 35, 36 and 37. Here, first quadrupole lens C1 vertically shrinks and horizontally elongates the diameter of the electron beam incident upon secondary quadrupole lens C2.

As a result, when passing main lens C3 after passing secondary quadrupole lens C2, the position of the electron beam is virtually the same as when the dynamic focusing is not carried out at the screen center.

More specifically, since the electron beam strikes secondary quadrupole lens C2 with a small vertical diameter, the electron beam diverges therefrom at a small angle. Then the electron beam is collimated while under a small aberration of main lens C3, and is incident upon the central portion of deflection yoke convergent lens C4. Since the diameter of the incident electron beam is small, the electron beam is under a weak convergent action by deflection yoke convergent lens C4 and the focal length is elongated. Since the electron beam is incident upon secondary quadrupole lens C2 with a large horizontal diameter, the electron beam is collimated while with the large diameter. Passing main lens C3, the electron beam is focused under an intense aberration to strike the central portion of deflection yoke divergent lens C4. Since the diameter of the incident electron beam is small, the electron beam is under a weak divergent action by deflection yoke divergent lens C4, to lessen the horizontal divergent angle.

As a result, the electron beam spot landing on the periphery of the phosphor screen is elongated vertically and reduced horizontally so that the difference of the height and width of the electron beam is decreased. Therefore, the ratio more closely approximates 1 (height/width$\approx$0.8).

Embodiment 2

Figure 4:
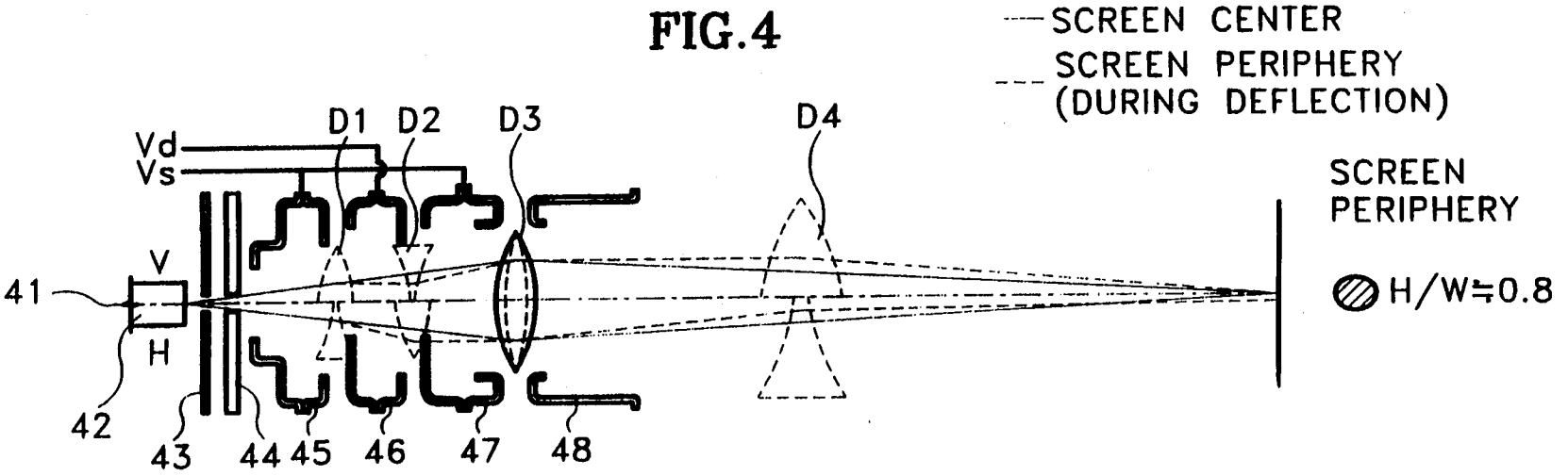
FIG. 4 is a schematic cross-sectional view of a second embodiment of the present invention.

Referring to FIG. 4, a dynamic focusing electron gun comprises cathode 42, first grid 43 and second grid 44 which constitute a triode, first quadrupole lens D1 and secondary quadrupole lens D2 which have opposite polarities, first, second and third focusing electrodes 45, 46 and 47 which form first and secondary quadrupole lenses D1 and D2, and accelerating electrode 48 installed adjacent to third focusing electrode 47 to form main lens D3.

Three horizontally-elongated electron beam passing holes are provided on the electron beam outgoing plane of first focusing electrode 45. Three vertically-elongated electron beam passing holes and three horizontally-elongated electron beam passing holes are formed on the electron beam incoming and outgoing planes of second focusing electrode 46, respectively. Three vertically-elongated electron beam passing holes are formed on the electron beam incoming plane of third focusing electrode 47.

Static focus voltage Vs is applied to first and third focusing electrodes 45 and 47. Dynamic focus voltage Vd modulated by being synchronized with the deflection signal of the deflection yoke is applied to second focusing electrode 46. The result is the same as that of the first embodiment.

Embodiment 3

Figure 5:
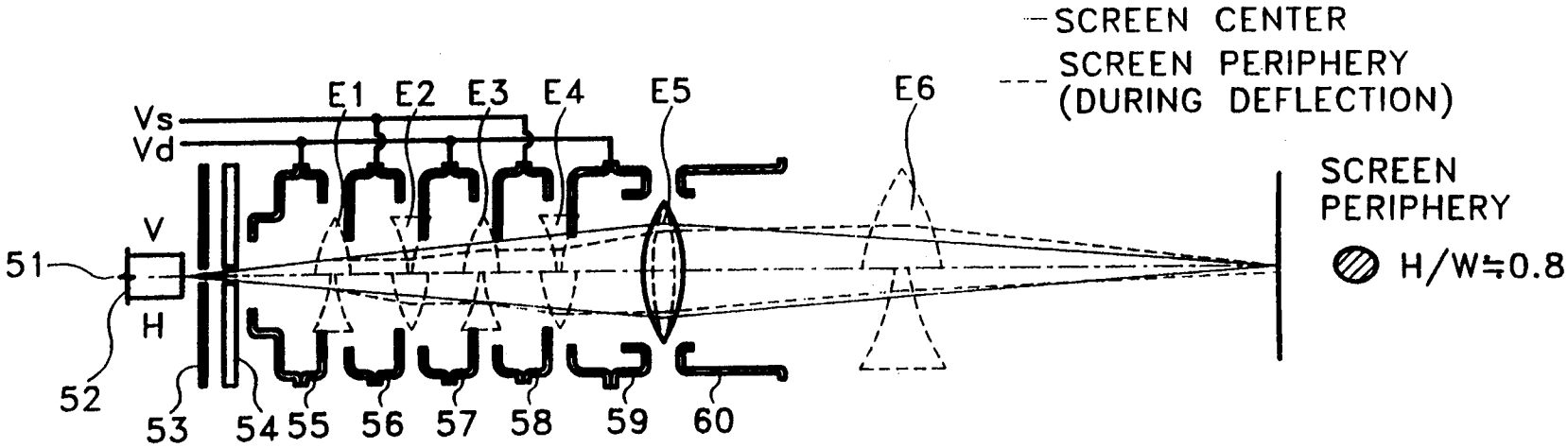
FIG. 5 is a schematic cross-sectional view of a third embodiment of the present invention.

Referring to FIG. 5, in the dynamic focusing electron gun, third focusing electrode 57, as a final focusing electrode in the first embodiment, is divided to form two electrostatic quadrupole lenses having opposite polarities. The electron gun comprises cathode 52, first grid 53 and second grid 54 which constitute a triode, two pairs of first quadrupole lens E1 and secondary quadrupole lens E2 and third quadrupole lens E3 and fourth quadrupole lens E4 which have alternating polarities, first, second and third focusing electrodes 55, 56 and 57 which form first and secondary quadrupole lenses E1 and E2, third, fourth and fifth focusing electrodes 57, 58 and 59 which form third, fourth quadrupole lenses E3 and E4, and accelerating electrode 60 installed adjacent to fifth focusing electrode 59 to form main lens E5.

Three vertically-elongated electron beam passing holes are provided on the electron beam outgoing plane of third grid 55. Three horizontally-elongated electron beam passing holes and three vertically-elongated electron beam passing holes are formed on the electron beam incoming and outgoing planes of second focusing electrode 56, respectively. Three horizontally-elongated electron beam passing holes are formed on the electron beam incoming plane of third focusing electrode 57. Three vertically-elongated electron beam passing holes are formed on the electron beam outgoing plane of third focusing electrode 57. Three horizontally-elongated electron beam passing holes and three vertically-elongated electron beam passing holes are formed on the electron beam incoming plane and the electron beam outgoing plane of fourth focusing electrode 58, respectively. Three horizontally-elongated electron beam passing holes are formed on the incoming plane of fifth focusing electrode 59.

Dynamic focus voltage Vd modulated by being synchronized with the deflection signal of the deflection yoke is applied to first, third and fifth focusing electrodes 55, 57 and 59. Static focus voltage Vs is applied to second and fourth focusing electrodes 56 and 58. The result is the same as that of the first embodiment.

Embodiment 4

Referring to FIG. 6, in the dynamic focusing electron gun, third focusing electrode 67, as a final focusing electrode in the second embodiment is divided to form two electrostatic quadrupole lenses having opposite polarities. The electron gun comprises cathode 62, first grid 63 and second grid 64 which constitute a triode, two pairs of first quadrupole lens F1 and secondary quadrupole lens F2 and third quadrupole lens F3 and fourth quadrupole lens F4 which have the alternating polarities, first, second and third focusing electrodes 65, 66 and 67 which form first and secondary quadrupole lenses F1 and F2, third, fourth and fifth focusing electrodes 67, 68 and 69 which form third, fourth quadrupole lenses F3 and F4, and accelerating electrode 70 installed adjacent to fifth focusing electrode 69 to form main lens F5.

Three horizontally-elongated electron beam passing holes are provided on the electron beam outgoing plane of first focusing electrode 65. Three vertically-elongated electron beam passing holes and three horizontally-elongated electron beam passing holes are formed on the electron beam incoming and outgoing planes of second focusing electrode 66, respectively. Three vertically-elongated electron beam passing holes are formed on the electron beam incoming plane of third focusing electrode 67. Three horizontally-elongated electron beam passing holes are formed on the electron beam outgoing plane of second focusing electrode 67. Three vertically-elongated electron beam passing holes and three horizontally-elongated electron beam passing holes are formed on the electron beam incoming plane and the electron beam outgoing plane of fourth focusing electrode 68, respectively. Three vertically-elongated electron beam passing holes are formed on the incoming plane of fifth focusing grids 69.

Static focus voltage Vs is applied to first, third and fifth focusing grids 65, 67 and 69. Dynamic focus voltage Vd modulated by being synchronized with the deflection signal of the deflection yoke is applied to second focusing electrode 66 and fourth focusing electrode 68. The result is the same as that of the first embodiment.

In the embodiments, the electron beam passing holes opposing the first, second, third, fourth and fifth focusing grids are in the form of a vertically-elongated or horizontally-elongated rectangle 71. However, not confined to these forms, as shown in FIG. 7, this invention may use at least one of the following electron beam passing hole formations: a vertically-elongated or horizontally-elongated rectangle with central circle 72 (a rectangle the aperture of which is expanded by a circle portion protruding from the central long side), a circle attached with vertically-elongated or horizontally-elongated strips 73, or a circle attached with vertically-elongated or horizontally-elongated rectangular strip 74.

As described above, in the dynamic focusing electron gun of the present invention, the height of the electron beam spot is increased on the screen periphery so that the vertical size ratio with the electron beam passing holes in the shadow mask is improved. This eliminates the moiré phenomenon. Horizontally, the horizontal elongation of the electron beam spot is reduced to enhance the resolution. This allows a nearly-circular electron beam spot on the periphery of the screen, thereby accomplishing a good quality picture throughout the screen. Further, the excessive vertical compression of the electron beam spot is alleviated on the screen periphery, to decrease the difference in size of the electron beam spots on the screen center with respect to those on its periphery. This improves picture quality on the screen's periphery without sacrificing the picture quality of the screen's center, thereby obtaining a sharp picture from a low-current area to a high-current area.

What is claimed is:

1. A dynamic focusing electron gun comprising:

a cathode and first and second grids which collectively form a triode;

a plurality of electrodes for forming an auxiliary lens; and an anode installed adjacent to the final electrode of said auxiliary lens to form a main lens, wherein electron beam passing holes are formed in each of said plurality of electrode for forming said auxiliary lens so that an electron beam is repeatedly and alternately deformed in the sequence of the vertically-elongated and then horizontally-elongated shapes, so as to form more than two quadrupole lenses of opposing polarities.

2. A dynamic focusing electron gun as claimed in claim 1, wherein;

said auxiliary lens has three electrodes, three vertically-elongated electron beam passing holes are provided in the electron beam outgoing plane of a first focusing electrode of said auxiliary lens, a set of three horizontally-elongated electron beam passing holes and a set of three vertically-elongated electron beam passing holes are formed in the electron beam incoming and outgoing planes of a second focusing electrode of said auxiliary lens, respectively, three horizontally-elongated electron beam passing holes are formed in the electron beam incoming plane of a third focusing electrode of said auxiliary lens, a dynamic focus voltage modulated by being synchronized with a deflection signal of a deflection yoke is applied to said first and third focusing electrodes, and a static focus voltage is applied to said second focusing electrode to form the more than two quadrupole lenses of opposing polarities.

3. A dynamic focusing electron gun as claimed in claim 2, wherein said electron beam passing holes formed in the beam passing plane of said first, second and third focusing electrodes are in the form of a rectangle with a circle portion protruding from the center of the long side so as to have an expanded aperture.

4. A dynamic focusing electron gun as claimed in claim 1, wherein:

said auxiliary lens has three electrodes, three circular electron beam passing holes are provided in the electron beam outgoing plane of a first focusing electrode of said auxiliary lens, a first set of three circular electron beam passing holes and a second set of three circular electron beam passing holes are formed in the electron beam incoming and outgoing planes of a second focusing electrode of said auxiliary lens, respectively, three circular electron beam passing holes are formed in the electron beam incoming plane of a third focusing electrode of said auxiliary lens, vertical strips for intensifying the horizontal electric field are provided on either side of said circular beam passing holes formed in the electron beam outgoing plane of said first and second focusing electrodes, and horizontal strips for intensifying the vertical electric field are provided on the top and bottom of said circular beam passing holes formed in the electron beam incoming plane of said second and third focusing electrodes.

5. A dynamic focusing electron gun as claimed in claim 4, wherein the opposing ends of said strips formed in the beam passing plane of said first, second and third focusing electrodes are joined so as to establish a rectangular shape.

6. A dynamic focusing electron gun as claimed claim 1, wherein;

said auxiliary lens has five electrodes, three vertically-elongated electron beam passing holes are provided in the electron beam outgoing plane of a first focusing electrode of said auxiliary lens, a set of three horizontally-elongated electron beam passing holes and a set of three vertically-elongated electron beam passing holes are formed in the electron beam incoming and outgoing planes of a second focusing electrode of said auxiliary lens, respectively, a set of three horizontally-elongated electron beam passing holes and a set of three vertically-elongated electron beam passing holes are formed in the electron beam incoming and outgoing planes of a third focusing electrode of said auxiliary lens, respectively, a set of three horizontally-elongated electron beam passing holes and a set of three vertically-elongated electron beam passing holes are formed in the electron beam incoming and outgoing planes of fourth focusing electrode of said auxiliary lens, respectively, three horizontally-elongated electron beam passing holes are formed in the incoming plane of a fifth focusing electrode of said auxiliary lens, a dynamic focus voltage modulated by being synchronized with a deflection signal of a deflection yoke is applied to said first, third and fifth focusing electrodes, and a static focus voltage is applied to said second and fourth focusing electrodes.

7. A dynamic focusing electron gun as claimed in claim 6, wherein said electron beam passing holes formed in the respective beam passing planes of said first, second, third, fourth and fifth focusing electrodes are in the form of a vertically-elongated or horizontally-elongated rectangle with a circle portion protruding from the center of the long side, so as to have an expanded aperture.

8. A dynamic focusing electron gun as claimed in claim 1, wherein:

said auxiliary lens has five electrodes, three circular electron beam passing holes are provided in the electron beam outgoing plane of a first focusing electrode of said auxiliary lens, a first set of three circular electron beam passing holes are formed in each of the electron beam incoming and outgoing planes of a second focusing electrode of said auxiliary lens, respectively, a second set of three circular electron beam passing holes are formed in each of the electron beam incoming and outgoing planes of a third focusing electrode of said auxiliary lens, respectively, a third set of three circular beam passing holes are formed in each of the electron beam incoming and outgoing planes of fourth focusing electrode of said auxiliary lens, respectively, three circular electron beam passing holes are formed in the incoming plane of a fifth focusing electrode of said auxiliary lens, vertical strips for intensifying the horizontal electric field are provided on either side of said circular beam passing holes formed in the electron beam outgoing plane of said first, second, third, fourth and fifth focusing electrodes, and horizontal strips for intensifying the vertical electric field are provided on the top and bottom of said circular beam passing holes formed in the electron beam incoming plane of said second, third, fourth and fifth focusing electrodes.

9. A dynamic focusing electron gun as claimed in claim 8, wherein the opposing ends of said strips formed in the respective beam passing planes of said first, second, third, fourth and fifth focusing electrodes are joined so as to establish a rectangular shape.

10. A dynamic focusing electron gun comprising:

a cathode and first and second grids which collectively form a triode;

a plurality of electrodes for forming an auxiliary lens; and an anode installed adjacent to the final electrode of said auxiliary lens to form a main lens, wherein electron beam passing holes are formed in each of said plurality of electrodes for forming said auxiliary lens so that an electron beam is repeatedly and alternately deformed in the sequence of the horizontally-elongated and then vertically-elongated shapes, so as to form more than two quadrupole lenses of opposing polarities.

11. A dynamic focusing electron gun as claimed in claim 10, wherein:

said auxiliary lens has three electrodes, three horizontally-elongated electron beam passing holes are provided in the electron beam outgoing plane of a first focusing electrode of said auxiliary lens, a set of three vertically-elongated electron beam passing holes and a set of three horizontally-elongated electron beam passing holes are formed in the electron beam incoming and outgoing planes of a second focusing electrode of said auxiliary lens, respectively, three vertically-elongated electron beam passing holes are formed in the electron beam incoming plane of a third focusing electrode of said auxiliary lens, and a static focus voltage is applied to said first and third focusing electrodes, and a dynamic focus voltage modulated by being synchronized with a deflection signal of a deflection yoke is applied to said second focusing electrode to form the more than two quadrupole lenses of opposing polarities.

12. A dynamic focusing electron gun as claimed in claim 11, wherein said electron beam passing holes formed in the beam passing plane of said first, second and third focusing electrodes are in the form of a rectangle with a circle portion protruding from the center of the long side, so as to have an expanded aperture.

13. A dynamic focusing electron gun as claimed in claim 10 wherein:

said auxiliary lens has three electrodes, three circular electron beam passing holes are provided in the electron beam outgoing plane of a first focusing electrode of said auxiliary lens, a set of three circular electron beam passing holes are formed in each of the electron beam incoming and outgoing planes of a second focusing electrode of said auxiliary lens, respectively, three circular electron beam passing holes are formed in the electron beam incoming plane of a third focusing electrode of said auxiliary lens, horizontal strips for intensifying the vertical electric field are provided on either side of said circular beam passing holes formed in the electron beam outgoing plane of said first and second focusing electrodes, and vertical strips for intensifying the horizontal electric field are provided on either side of said circular beam passing holes formed in the electron beam incoming plane of said second and third focusing electrodes.

14. A dynamic focusing electron gun as claimed in claim 13, wherein the opposing ends of said strips formed in the beam passing plane of said first, second and third focusing electrodes are joined so as to establish a rectangular shape.

15. A dynamic focusing electron gun as claimed claim 10, wherein:

said auxiliary lens has five focusing electrodes, three horizontally-elongated electron beam passing holes are provided in the electron beam outgoing plane of a first focusing electrode, a set of three vertically-elongated electron beam passing holes and a set of three horizontally-elongated electron beam passing holes are formed in the electron beam incoming and outgoing planes of a second focusing electrode, respectively, a set of three vertically-elongated electron beam passing holes and a set of three horizontally-elongated electron beam passing holes are formed in the electron beam incoming and outgoing planes of a third focusing electrode, respectively, a set of three vertically-elongated electron beam passing holes and a set of three horizontally-elongated electron beam passing holes are formed in the electron beam incoming and outgoing planes of a fourth focusing electrode of said auxiliary lens, respectively, three vertically-elongated electron beam passing holes are formed in the incoming plane of a fifth focusing electrode of said auxiliary lens, a static focus voltage is applied to said first, third, fifth focusing electrodes, and a dynamic focus voltage modulated by being synchronized with a deflection signal of a deflection yoke is applied to said second and fourth focusing electrodes.

16. A dynamic focusing electron gun as claimed in claim 15, wherein said electron beam passing holes formed in the beam passing plane of said first, second, third, fourth and fifth focusing electrodes are in the form of a rectangle with a circle portion protruding from the center of the long side, so as to have an expanded aperture.

17. A dynamic focusing electron gun as claimed in claim 10, wherein:

said auxiliary lens has five focusing electrodes, three circular electron beam passing holes are provided in the electron beam outgoing plane of a first focusing electrode, a first set of three circular electron beam passing holes are formed in each of the electron beam incoming and outgoing planes of a second focusing electrode respectively, a second set of three circular electron beam passing holes are formed in each of the electron beam incoming and outgoing planes of a third focusing electrode, respectively, a third set of three circular electron beam passing holes are formed in each of the electron beam incoming and outgoing planes of a fourth focusing electrode of said auxiliary lens, respectively, three circular electron beam passing holes are formed in the incoming plane of a fifth focusing electrode of said auxiliary lens, horizontal strips for intensifying the vertical electric field are provided on the top and bottom of said circular beam passing holes formed in the electron beam outgoing plane of said first, second, third and fourth focusing electrodes, and vertical strips for intensifying the horizontal electric field are provided on either side of said circular beam passing holes formed in the electron beam incoming plane of said second, third, fourth and fifth focusing electrodes.

18. A dynamic focusing electron gun as claimed in claim 17, wherein the opposing ends of said strips formed in the beam passing plane of said first, second, third, fourth and fifth focusing electrodes are joined so as to establish a rectangular shape.

* * * * *